US007212213B2

(12) United States Patent
Steinberg et al.

(10) Patent No.: US 7,212,213 B2
(45) Date of Patent: May 1, 2007

(54) COLOR DISPLAY INSTRUMENT AND METHOD FOR USE THEREOF

(75) Inventors: Goodwin Steinberg, Palo Alto, CA (US); Robert A. Grimm, Los Altos, CA (US)

(73) Assignee: Steinberg-Grimm, LLC, Los Altos, CA (US)

( * ) Notice: Subject to any disclaimer, the term of this patent is extended or adjusted under 35 U.S.C. 154(b) by 139 days.

(21) Appl. No.: 10/247,605

(22) Filed: Sep. 18, 2002

(65) Prior Publication Data

US 2003/0117400 A1 Jun. 26, 2003

Related U.S. Application Data

(63) Continuation-in-part of application No. 10/028,809, filed on Dec. 21, 2001, now Pat. No. 6,791,568.

(51) Int. Cl.
*G09G 5/02* (2006.01)

(52) U.S. Cl. ..... 345/589; 345/440; 345/600; 84/470 R; 84/477 R; 84/483.1; 84/483.2

(58) Field of Classification Search ..... 84/477 R, 84/478, 701, 626, 672, 737, 33, 470 R; 345/589, 345/600

See application file for complete search history.

(56) References Cited

U.S. PATENT DOCUMENTS 3,577,824 A * 5/1971 Lavan ..... 84/478
3,969,972 A 7/1976 Bryant
5,048,390 A * 9/1991 Adachi et al. ..... 84/464 R
5,153,829 A * 10/1992 Furuya et al. ..... 84/622
5,159,140 A * 10/1992 Kimpara et al. ..... 84/600
5,286,908 A * 2/1994 Jungleib ..... 84/603
5,540,123 A * 7/1996 Lund ..... 81/57.3
5,665,927 A * 9/1997 Taki et al. ..... 84/609
5,689,078 A * 11/1997 McClard ..... 84/600
5,784,096 A 7/1998 Paist
5,886,273 A * 3/1999 Haruyama ..... 84/478
6,008,551 A 12/1999 Coray
6,046,724 A * 4/2000 Hvass ..... 345/600
6,078,004 A * 6/2000 Eitaki ..... 84/477 R
6,103,964 A * 8/2000 Kay ..... 84/611
6,127,616 A * 10/2000 Yu ..... 84/483.2
6,156,965 A * 12/2000 Shinsky ..... 84/650
6,169,239 B1 * 1/2001 Aiardo ..... 84/483.2
6,204,441 B1 * 3/2001 Asahi et al. ..... 84/470 R
6,225,545 B1 * 5/2001 Suzuki et al. ..... 84/477 R (Continued)

OTHER PUBLICATIONS

ChordWizard Music Theory; "Introduction to Music;" http://www.csdl.tamu.edu/~sucendud/Music/ChordWizard%20Music%20Theory.htm.*

*Primary Examiner*—Kee M. Tung
*Assistant Examiner*—Antonio Caschera
(74) *Attorney, Agent, or Firm*—Dorsey & Whitney LLP

(57) ABSTRACT

A method for graphically displaying on a display device, a musical note in a range of notes within an octave, in a range of octaves. The method including, determining the display attributes of a reference octave selected from the range of octaves, receiving a musical note, generating a representation of the received musical note using a note position of the received note in an octave and a relative octave position to the reference octave, and sending the representation for graphical display. A system is also disclosed.

25 Claims, 17 Drawing Sheets
(1 of 17 Drawing Sheet(s) Filed in Color)

U.S. PATENT DOCUMENTS 6,271,453 B1 * 8/2001 Hacker ..... 84/476
6,380,474 B2 * 4/2002 Taruguchi et al. ..... 84/612
6,388,181 B2 * 5/2002 Moe ..... 84/477 R
6,660,921 B2 * 12/2003 Deverich ..... 84/470 R
6,686,529 B2 * 2/2004 Kim ..... 84/464 R
6,841,724 B2 * 1/2005 George ..... 84/477 R
2002/0138523 A1 * 9/2002 Steinberg et al. ..... 707/528
2002/0178896 A1 * 12/2002 George ..... 84/477 R
2003/0000364 A1 * 1/2003 Deverich ..... 84/47

* cited by examiner

810

COLOR DISPLAY INSTRUMENT AND METHOD FOR USE THEREOF

CROSS-REFERENCES TO RELATED APPLICATIONS

This application is a Continuation-in-Part of U.S. patent application Ser. No. 10/028,809 filed Dec. 21, 2001 now U.S. Pat. No. 6,791,568, entitled ELECTRONIC COLOR DISPLAY INSTRUMENT AND METHOD, naming Goodwin Steinberg and Robert A. Grimm as inventors, with U.S. patent application Ser. No. 10/028,809 is incorporated by reference herein.

BACKGROUND OF THE INVENTION

1. Field of the Invention

This invention relates, in general, to musical instruments and more particularly a color display instrument for generating visual displays of notes and methods for their use.

2. Description of Related Art

Musical instruments are well known for producing sound. A number of modern musical instruments may be attached to musical devices for enhancing sound. Typically, the attachment include a MIDI (Musical Instrument Digital Interface) interface, which is a common standard for representing musical information in a digital format. For example, a piano keyboard may have a MIDI interface that can be attached to an amplifier. When a key is pressed on a piano keyboard, a MIDI signal is transmitted from the piano keyboard to the amplifier. The amplifier can interpret the transmitted signal to determine which note was pressed on the piano keyboard including a variety of attributes associated with the piano key pressed. Unfortunately, musical instruments generate sound and not graphical representations. Consequently, a beautiful melody can only be heard and never seen.

What is needed is a color display instrument which overcomes the above and other disadvantages of musical instruments and musical information stored in a digital format.

BRIEF SUMMARY OF THE INVENTION

In summary, one aspect of the present invention is directed to a method for graphically displaying on a display device, a musical note in a range of notes within an octave, in a range of octaves. The method includes, determining the display attributes of a reference octave selected from the range of octaves, receiving a musical note, generating a representation of the received musical note using a note position of the received note in an octave and a relative octave position to the reference octave, and sending the representation for graphical display.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
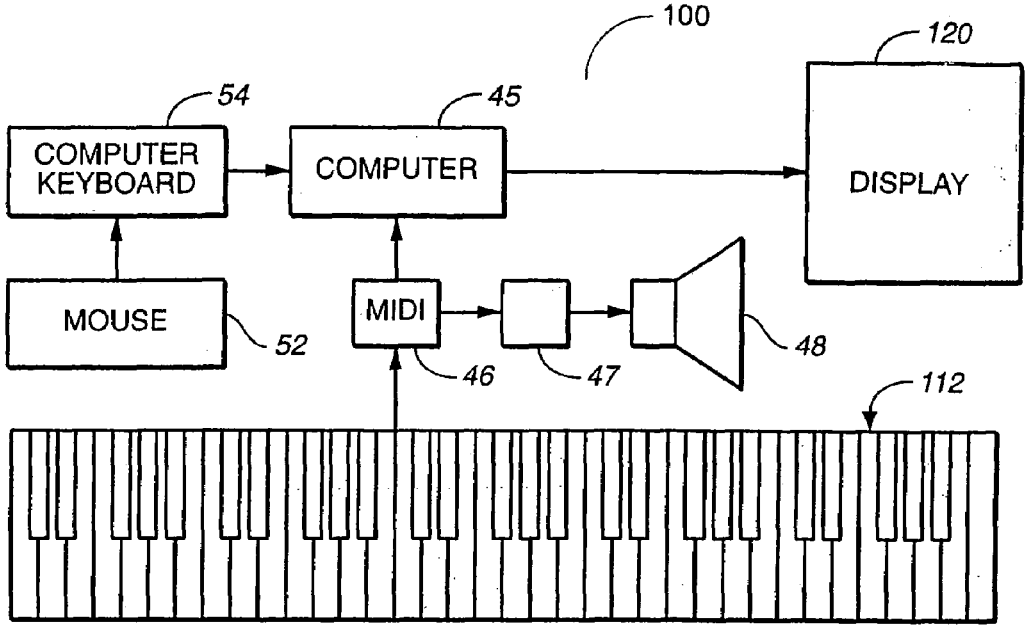
FIG. 1 is a block diagram of a color display instrument employing a personal computer and piano keyboard, in accordance with the present invention.

Turning now to the drawings, wherein like components are designated by like reference numerals throughout the various figures, attention is directed to FIG. 1 illustrating a color display instrument. The color display instrument may include a personal computer 45 which is programmed to receive notes from a piano-like keyboard 112. Depression of a key on the piano-like keyboard gives an output digital note indicative of the key. The digital note may include information representing the key and further including information regarding duration, intensity, velocity, etc. of the keys depression. One such digital coding system 46 can, for example, be the coding system known as MIDI. A keyboard capable of playing music may also include a sound circuit 47 for processing the digital signals and driving one or more speakers 48.

It should also be apparent that a variety of musical formats, graphical formats, methods, processing approaches, and/or combinations may be used in accordance with the present invention. According to one embodiment, the personal computer 45 may be programmed to receive digital notes, analog notes, and/or a combination, such as for example, digital notes from the piano-like keyboard 112 and analog notes from a singer's microphone. According to one embodiment, the computer 45 may receive analog inputs and may generate analog outputs. Further, a digital and/or analog computer keyboard 54 may be coupled with the computer 45. A variety of implementations may be used in support of the present invention.

In accordance with one embodiment of the present invention, the computer that receives the digital notes may include a stored color lookup table or palette (not shown). The table may include a coded color for each of the keys or tones represented by the keys of a particular instrument. The color palette can be created by a musician/artist. The color code can, for example, be based on the Munsell color code, which gives a proper ratio of primary colors (read, blue and green) for the generation of each color representing a key or note.

Figure 2:
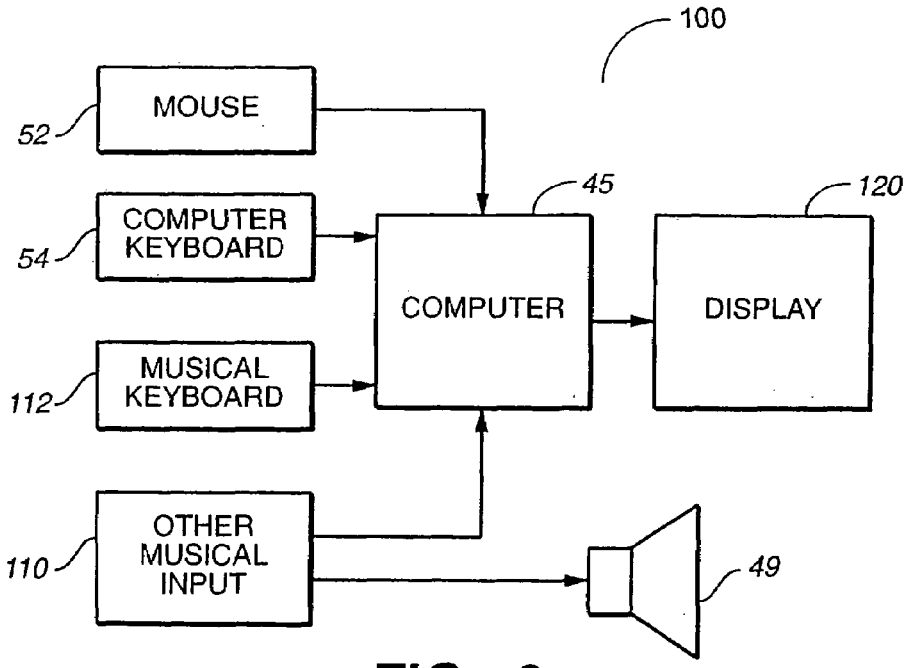
FIG. 2 is a block diagram of another embodiment of color display instrument, in accordance with the present invention.

FIG. 2 illustrates one contemplated use of the instrument to synchronize the color display with existing music and musicals. A record player, compact disc player, other musical instrument and/or other instrument, may provide a musical note source 110. Notes from a source can either be digital or digitized and applied to the computer which may be programmed and controlled by the musician/artist to generate a visual representation of the music that may be synchronized with music emanating from speakers 49. The instrument also allows artist/musician to play with light as a musician does with sound to create artistic displays. A generated representation, based on the notes received from the instrument and other input sources, can be recorded for later playback. A musician/artist can play music on the piano or other instrument and generate the digital representation of the notes and also use a computer keyboard to generate inputs, all of which can be applied to the computer to provide a visual color display.

It is apparent that a computer can be programmed to control the music display instrument, such as for example, controlling the amplitude or brightness of the colors. It is also possible to have features such as vibrato, wherein the color waivers about a central color. If two or more color keys are depressed simultaneously, the colors could be mixed visually by alternating rapidly between the colors such the viewers eye combines the colors. Alternatively, the colors could be alternately displayed in adjacent small areas such the viewers eye combines the images of intermixed color dots. Incorporation of a computer with the music display instrument enables the creation of many specialized effects. For example, the musical characteristic or attributes of a note, such as pitch, timbre, volume, attack and decay may be taken into consideration when generating representations of the note. Correspondingly, the musician/artist can specify and program the computer to convert audible notes into visual displays.

Figure 3:
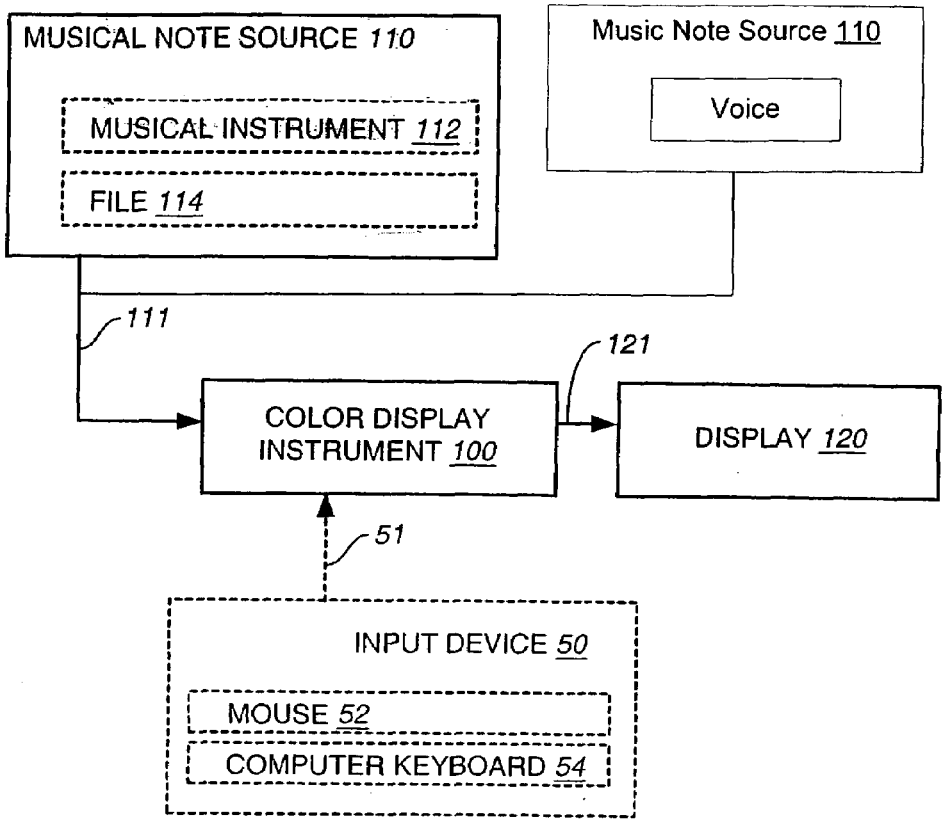
FIG. 3 is a block diagram of a system including a color display instrument, in accordance with the present invention.

FIG. 3 illustrates a system including a color display instrument, generally designated 100. The color display instrument 100 is coupled with a musical note source 110 using the musical note interface 111, and is coupled with a display 120 using the display interface 121, and is optionally coupled with the input device 50 using an input interface 51. The color display instrument 100 translates a musical note received from the musical notes source into graphical images that may be sent to the display 120. Information from the input device 50 may also be used in generating a graphical representation.

The musical note source 110 may be a musical instrument 112 that is a source of the musical notes received by the color display instrument 100 through the interface 111. Similarly, a file 114 may represent the musical notes source 110. The interface 111 is used to communicate musical notes from the musical note source to the color display instrument. A variety of interfaces may be used, such as the MIDI interface and/or analog interface.

The display 120 is coupled with the color display instrument 100 using a display interface 121. A variety of different display types and display interfaces may be utilized. According to one embodiment, the display 120 is a color television set and/or a color computer monitor.

An input device 50 may be used to control and/or interact with the color display instrument 100. A variety of different input devices and input interfaces may be utilized. Several optional input devices may include a mouse 52 and a computer keyboard 54.

According to one embodiment, an input device 50 may be used to adjust, refine, and/or re-adjust the functionality and attributes of the color display instrument 100. The input device 50 may be used to define patterns, colors, shapes, intensities, positions, one or more musical note sources, a variety of other attributes, and/or a variety of combinations. A visualization of a resulting display 120 corresponding with one or more musical note source 110 may feed back into the color display instrument 100 by a user and/or automatically to control and/or interact with the color display instrument. Further, one or more dialog boxes may be used to facilitate the control and/or interaction with the color display instrument. According to one embodiment, the color display instrument 100 includes two musical notes sources 110, including a singer's voice and a piano keyboard. An input device 50 may be used for enhancing a first graphical display generated based on the note source representing the singer's voice, and may also be used to diminish a second graphical display generated based on the note source representing the piano keyboard. Further, the two graphical displays may be displayed simultaneously and/or combined into a third graphical display.

Figure 4:
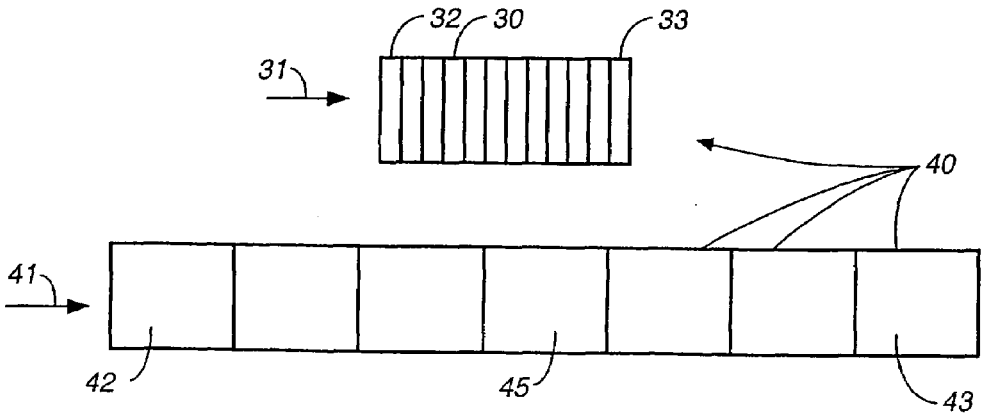
FIG. 4 is a block diagram of a note in a note group, in accordance with the present invention.

As shown in FIG. 4 a note 30 is defined within a note group 40. The note group 40 includes a range of notes 31 including a first note 32 and the last note 33. The note group 40 is typically defined in a range of note groups 41 including a first note group 42 and the last note group 43. A reference note group 45 is defined as one of the note groups within the range of note groups 41. Each note group 40 in the range of note groups 41 may be defined according to the position of the note group 40 relative to the reference note group 45. For example, if the reference note group 45 is the middle note group 40 then the note group 43 may be described as a plus 3 note group because it is the third note group to the right of the reference note group 45. Similarly, the note group 42 may be described as a minus 3 note group because it is the third note group to the left of the reference note group 45.

According to one embodiment each note group 40 represent an octave including a range of notes 31 including 12 notes and having a first note 32 and a last note 33. The range of note groups 41 may represents the octaves corresponding to an 88 key piano keyboard.

Figure 5:
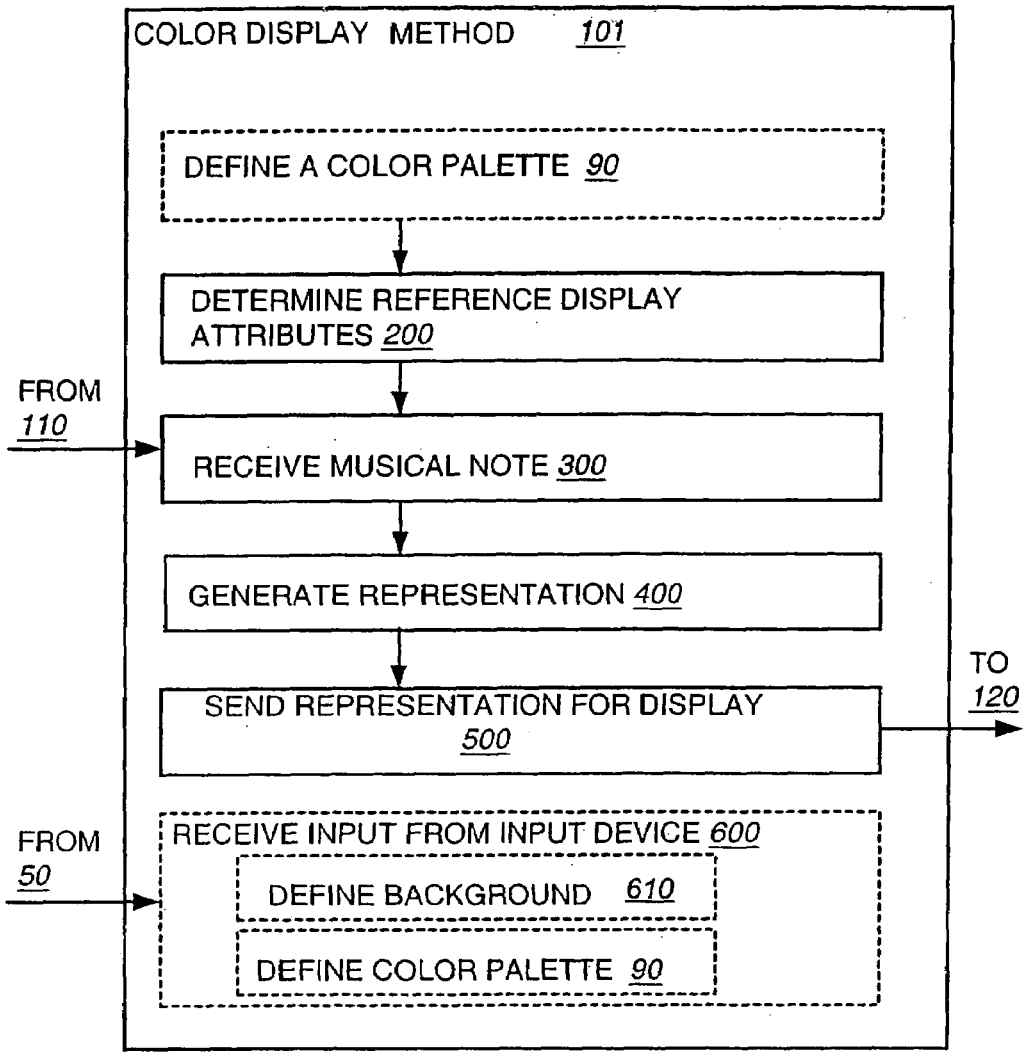
FIG. 5 is a flowchart illustrating the operation of the color display instrument, according to the present invention.

FIG. 5 describes an exemplary method 101 for the operation of a color display instrument 100. Initially a color palette may be defined at 90. Reference display attributes are determined at 200. A musical note is a received at 300 from the musical notes source 110. The received musical note is then used to generate a representation at 400. The generated representation is then sent for display at 500 to a display device 120. Optionally, the color display instrument 100 may receive input from an input device 50 at 600. For example, the received input from an input device may be used to define a variety of information, such as for example, background information at 610. The received input may also be used to define the color palette at 90. Many other uses for the input received from an input device at 600 will also be apparent including interaction with the musical instrument.

Figure 6:
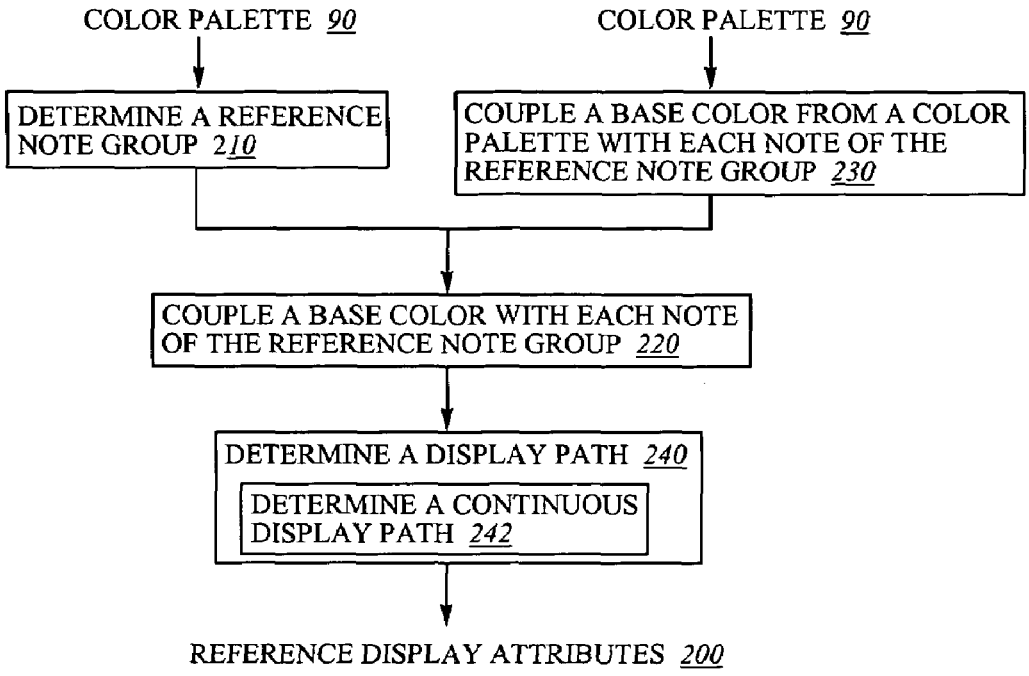
FIG. 6 is a flowchart illustrating the determination of reference display attributes, according to the present invention.

FIG. 6 describes an exemplary method 200 for determining reference display attributes. Determining a reference note group may be performed at 210 and a base color may be coupled with each note of the reference note group at 220. If the color palette had been defined at 90 then a color from the color palette may be coupled with each note of the reference note group at 230. Additionally the display path may be determined at 240 for displaying a note along the display path. In a preferred embodiment the display path is represented as a continuous line that may be determined at 242. Alternatively, the display path may represent path segments that may correspond with individual note groups.

Figure 7:
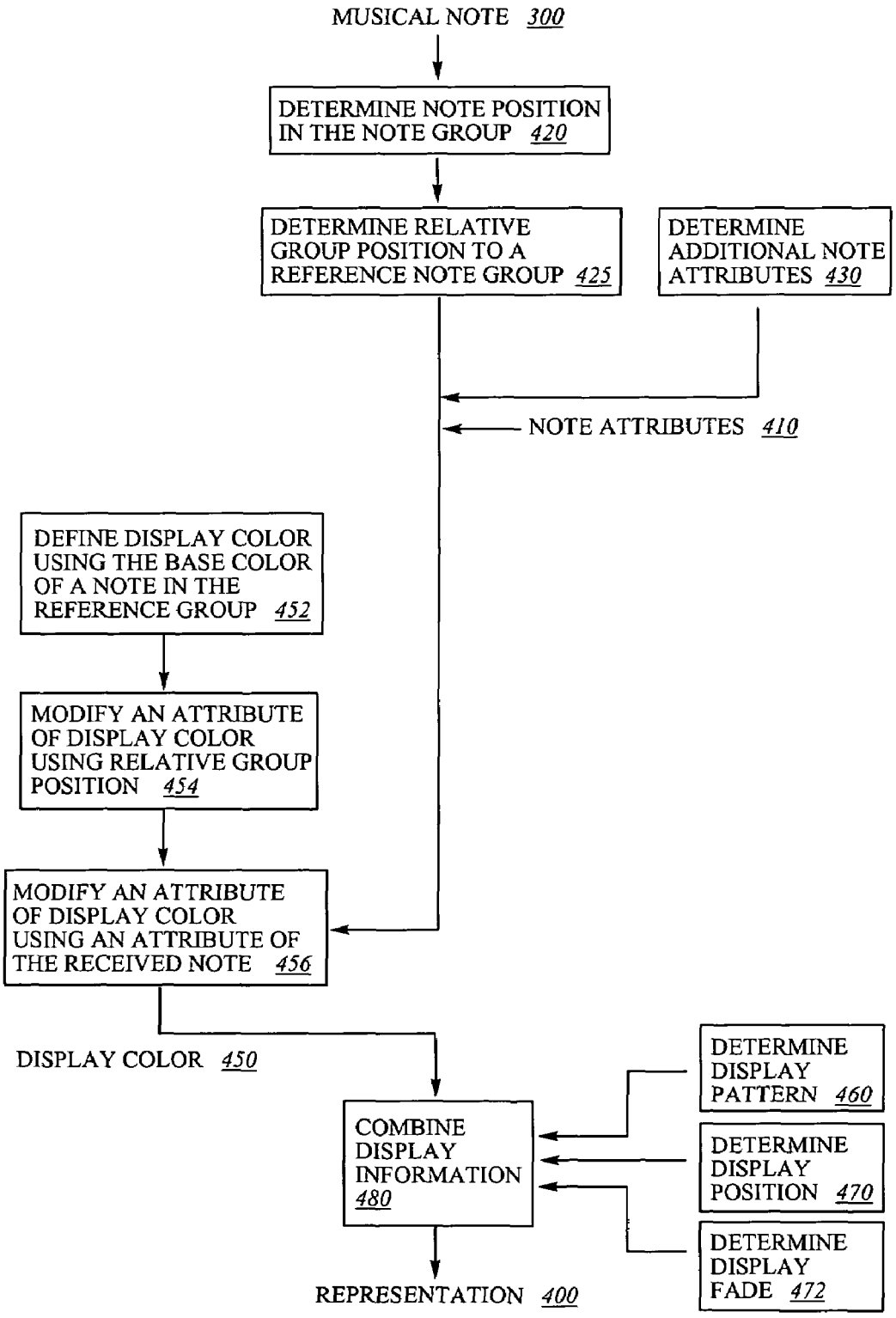
FIG. 7 is a flowchart illustrating the generate representation, according to the present invention.

FIG 7 describes an exemplary method 400 for generating a display. As illustrated, generating a display 400 includes determining note attributes 410 and determining display information 440. Determining the note attributes at 410 typically includes determining the note position within the note group at 420 and determining a relative group position to the reference note group 45 at 425. Additional note attributes may be determined at 430.

Determining the display information 440 may include determining a display color at 450, a display pattern at 460, a display position at 470, and other display information such as a display fade at 472. Determining a display color at 450 may include defining a display color using a base color of a note in the reference group at 452. For example, if the received note is the first note of an octave then the display color may be based on the color associated with the first note of the reference group.

Attributes of the display color may also be modified using the relative group position at 454. Attributes of the display color may also be modified using attributes of the received note at 456. For example, the generated representation for a received note may be based on the display color and attributes of the received note. Display information may then be combined at 480, and subsequently sent to the display device 120 and/or stored. Attributes of the display color may include hues, brightness, contrast and fading attributes. A variety of other color attributes may also be used. Attributes of the received note may include pitch, timbre, volume, attack and decay attributes. A variety of other note attributes may also be used.

Figure 8:
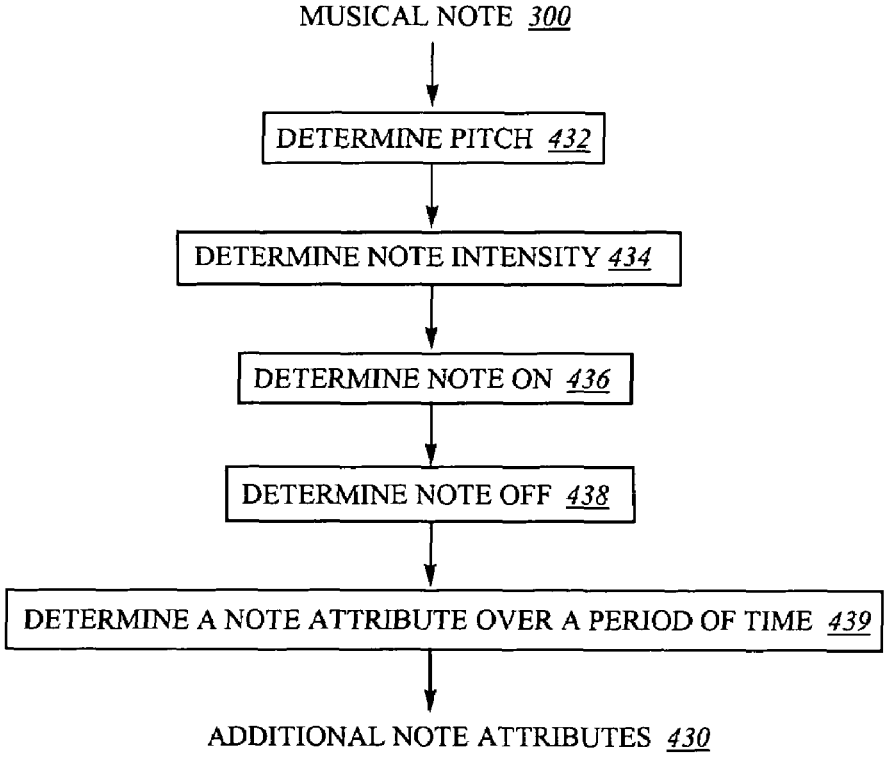
FIG. 8 is a flowchart illustrating the determine note attributes, according to the present invention.

Additional note attributes may be determined at 430 as illustrated in FIG. 8. Attributes such as the note pitch, note intensity, note on, note off may be determined at 432, 434, 436, and 438 respectively. Additionally, note attributes may be determined over a period of time at 439. For example, the length of time a key on a piano keyboard is depressed may be determined and subsequently used to generate the display.

Figure 9:
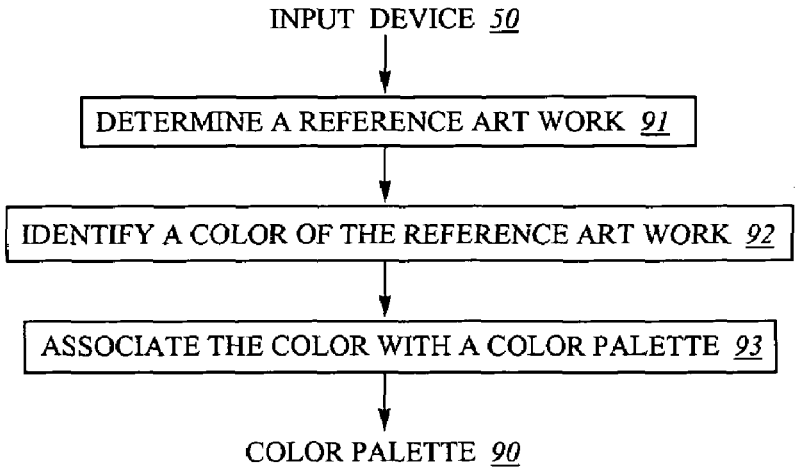
FIG. 9 is a flowchart illustrating the define color palette, according to the present invention.
Figure 10:
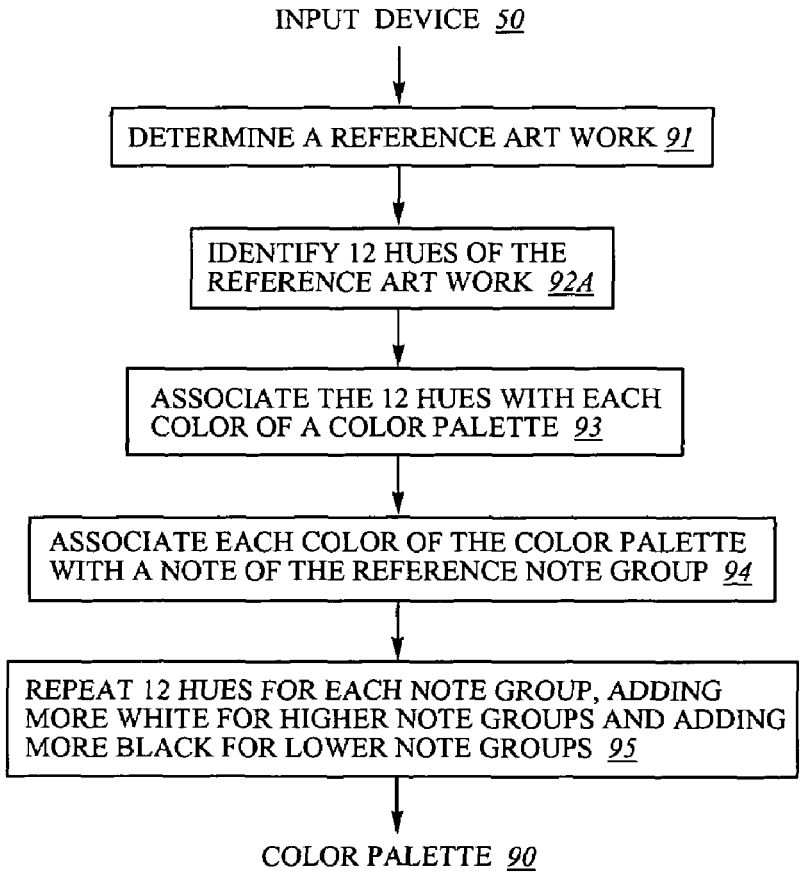
FIG. 10 is a flowchart illustrating the definition of a color palette, according to the present invention.

FIG. 9 describes a method 90 of defining a color palette. A reference artwork may be determined at 91. At least one color can be identified from the reference artwork at 92, and the color may be associated with a color of a color palette 93. Further, FIG. 10 illustrates an exemplary method of defining a color palette at 90*a* based on the determined artwork at 91. Twelve hues of the reference art work are identified at 92*a*, and the twelve hues are associated with each color of a color palette at 93. Then, each color in the color palette can be associated with a note of the reference note group at 94. Optionally, the association at 94 may be performed for each note group in the range of note groups 95. As described above the relative position of each note group 40 to a reference note group 45 may be used to modify a color attribute and define a display color. Accordingly, more white may be added to a color for higher note groups and more black may be added for lower note groups. Alternatively, a color may be associated with each note in the range of note groups 41.

Figure 11:
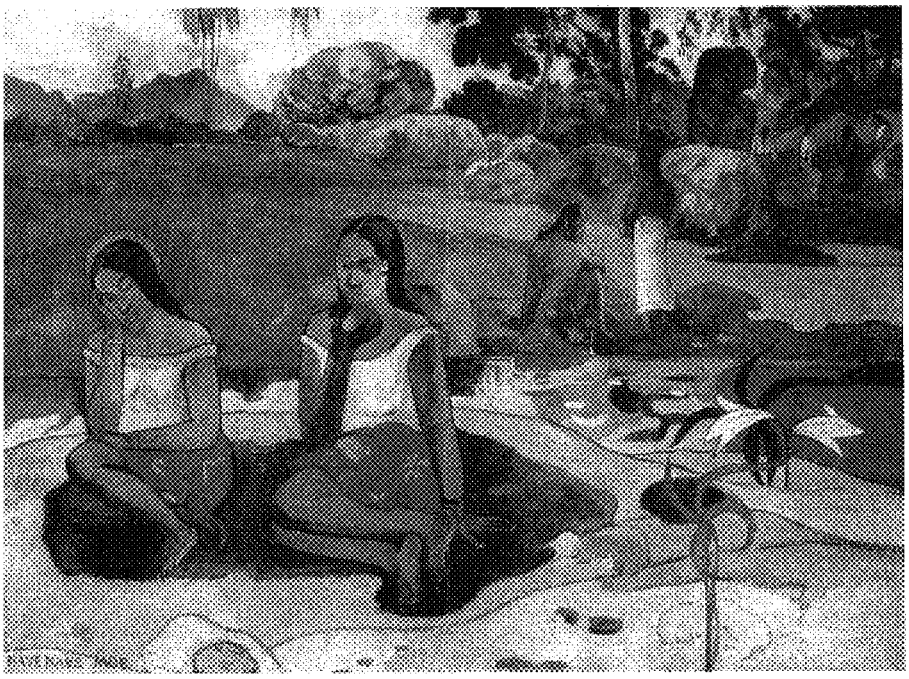
FIG. 11 is an example artwork for use according to the present invention.
Figure 12:
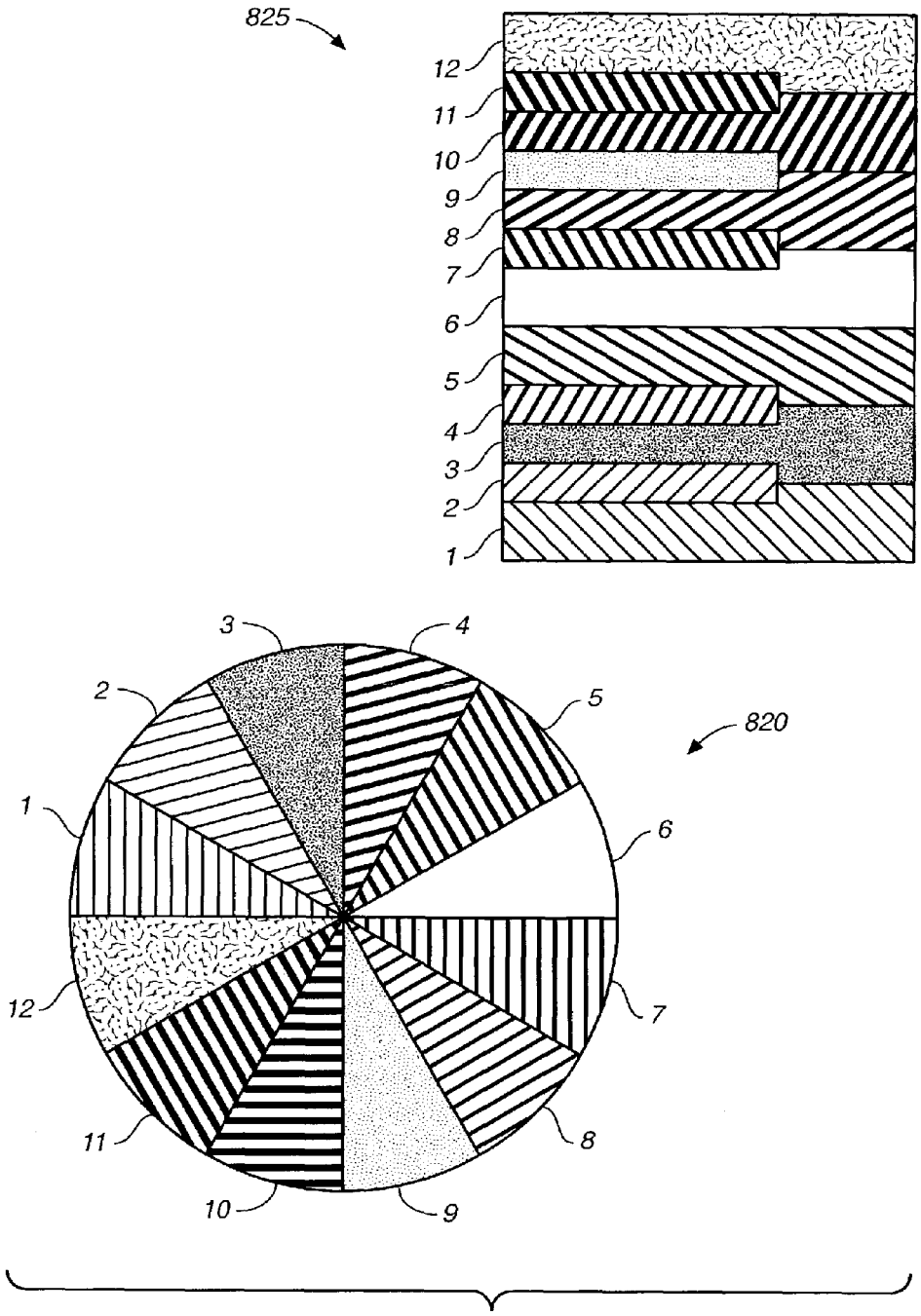
FIG. 12 is an example color wheel and a reference octave, according to the present invention.

FIG. 11 illustrates an example artwork 810 that may be used to defined at color palette at 90*a*. Using the artwork 810, twelve hues may be identified at 92*a*. The twelve hues may be associated with a color palette at 93. The color palette may also be represented as color wheel 820, illustrated in FIG. 12. The color wheel may include colors 1 through 12. Each color of the color wheel may be associated with a note of the reference note group at 94. For example, the range of notes corresponding to an octave 825 of a piano keyboard may be associated with the colors 1 through 12.

Figure 13:
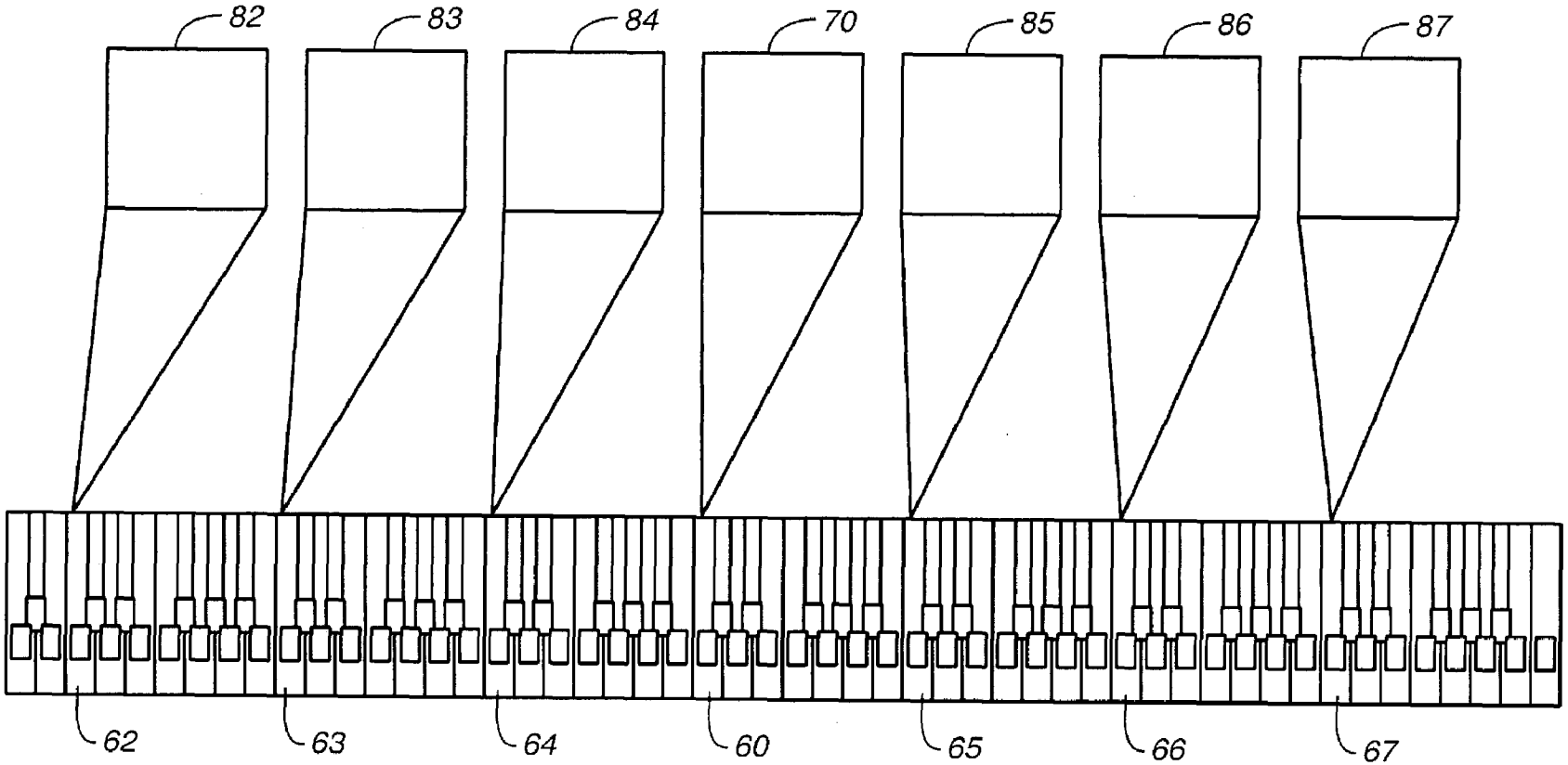
FIG. 13 is an illustrative mapping of a color associated with one note of a reference octave with similar notes in the range of octaves, according to the present invention.

FIG. 13 illustrates associating a display color for a given note within each octave. The middle octave may be a reference octave with each note in the reference octave associated with a reference color. And a display color may be defined for each note in each octave. For example, the reference octave may include a note 60 associated with a reference color 1, described in FIG. 12. The display color 70 for the note 60 may be the same as a reference color 1, because in this case the note 60 is within in the reference note group. A corresponding note 62 in the first octave may be described as a minus 3 octave as described above because it is the third octave to the left of the reference octave. Consequently, the relationship between the first octave and the reference octave may be taken into consideration when defining the display color 82 corresponding to the note 62. In one embodiment, octaves to the left of the reference octave may be assigned more black, such that the display color 82 corresponding to the note 62 may have three shades of black added to the display color.

The display color 83 corresponding with the note 63 of a minus two octave may have two shades of black of the reference color associated with a similar note in the reference octave. Similarly, the display color 84 corresponding with note 64 of a minus one octave may have one shade of black of the reference color associated with a similar note in the reference octave.

The display color 85 corresponding with the note 65 of a plus one octave may have one shade of white of the reference color associated with a similar note in the reference octave. The display color 86 corresponding with the note 66 of a plus two octave may have two shades of white of the reference color associated with a similar note in the reference octave. The display color 87 corresponding with the note 67 of a plus 3 octave may have three shades of white of the reference color associated with a similar note in the reference octave.

It should also be apparent that a variety of color attributes may be used in organizing the display colors for each note within the respective note groups and/or octaves. Additionally, the inputs from an input device 50 may also be taken into consideration when defining the display colors and the reference colors.

Figure 14:
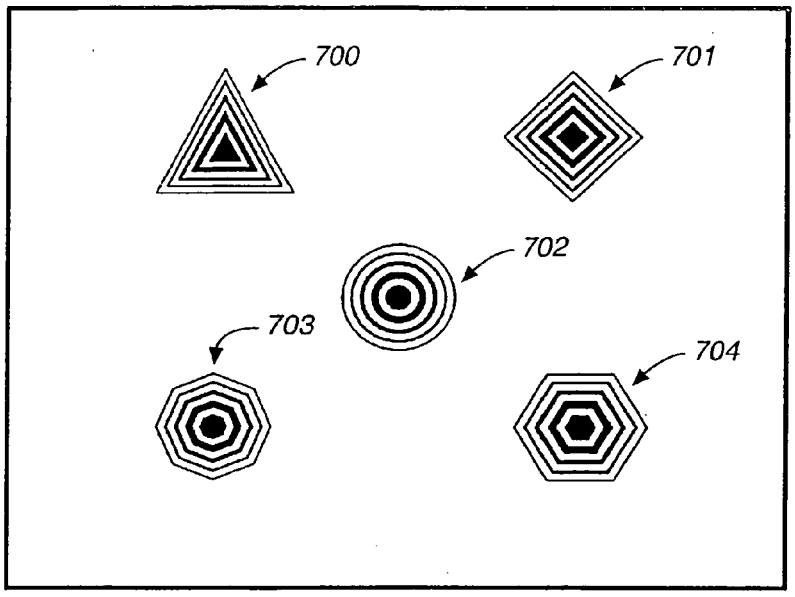
FIG. 14 illustrates example patterns for graphically representing a note, according to the present invention.

FIG. 14 illustrates several patterns that may be used to define a display pattern including a triangle 700, a square 701, a circle 702, an octagon 703, and a hexagon 704. As shown, each of the display patterns include five separate outlines of the same symbol. It should also be apparent that a variety of other symbols and combinations of symbols may be used to define a display pattern for received musical note.

Figure 15:
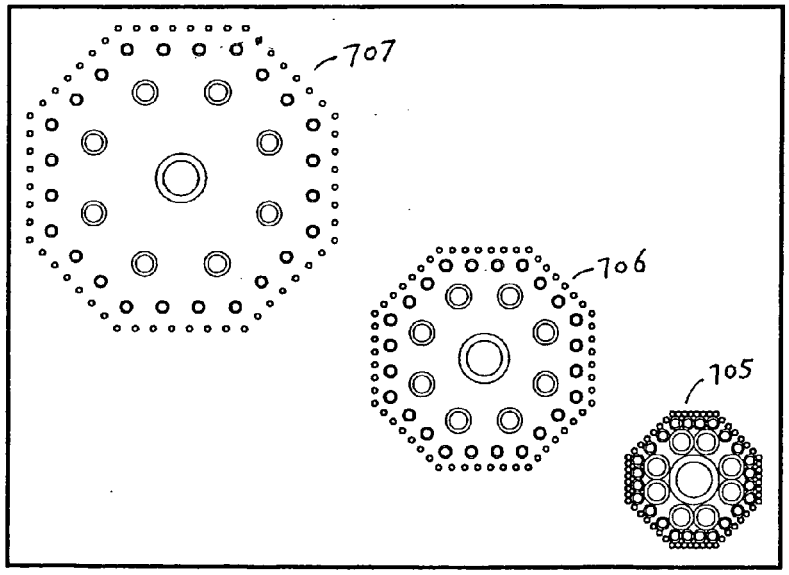
FIG. 15 is a series of example patterns that may be formed in succession to illustrate and exploding effect, according to the present invention.

As further illustrated in FIG. 15, a display pattern may be more complex. The display pattern 705 includes a variety of shapes which may be interrelated. The display pattern 705 may be expanded into the display pattern 706, and further expanded into the display pattern 707. For example, this expansion may be the result of depressing a key on a piano keyboard for a given duration of time. If the key is depressed for a first duration of time, such as, for example one second, the display pattern may evolve from the 705 pattern to a 706 pattern. If the key remains depressed for an additional one second then the display pattern may evolve from the 706 pattern to a 707 pattern. A variety of other combinations may be used to change the size and appearance of the note representation.

For example, the note intensity corresponding to a received note may be used to select a pattern. A note with a minimal intensity may result in the display pattern 705. A note with moderate intensity may result in the display pattern 706. Whereas, a note high intensity may result in the display pattern 707. Further, the note position may reside in the same location for a given note with the size of the display pattern varying based on the note intensity and/or other note attributes.

Figure 16:
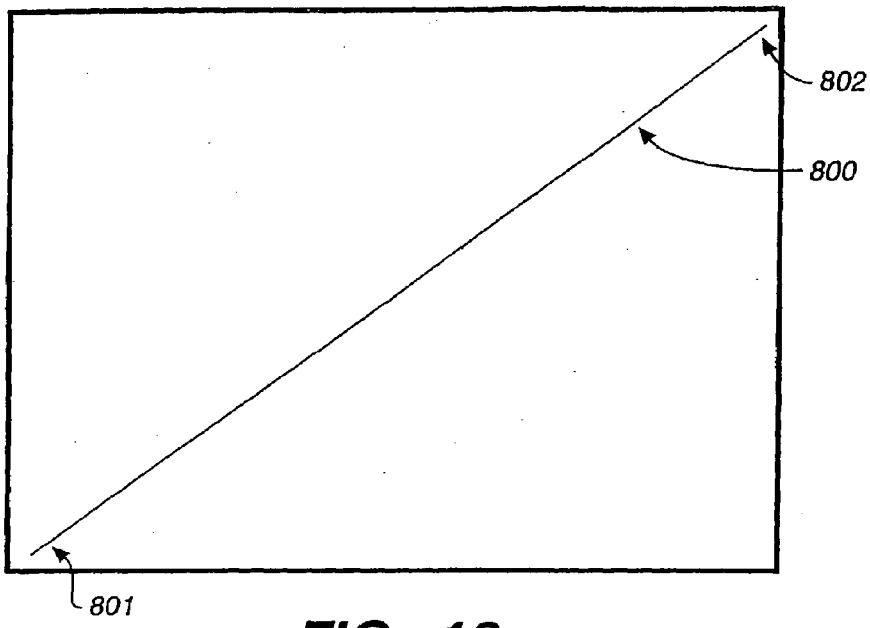
FIG. 16 is a perspective view of a display including a contiguous display path, according to the present invention.
Figure 17:
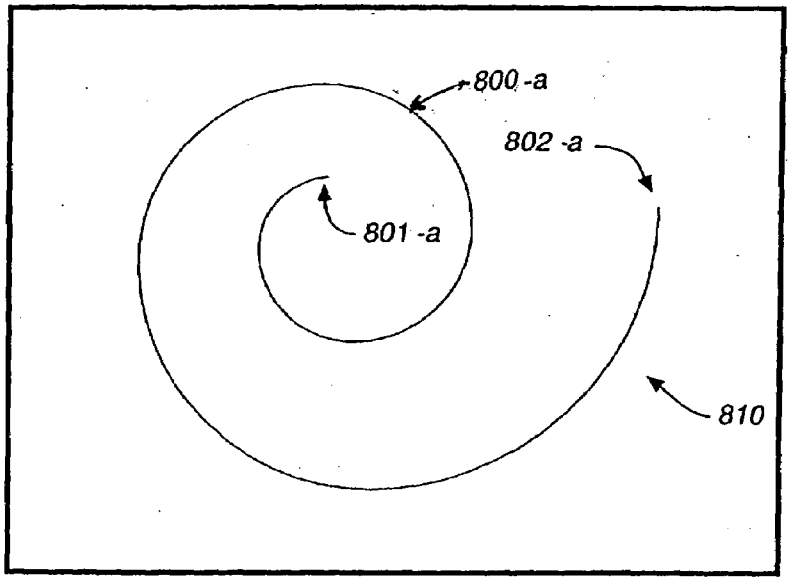
FIG. 17 is a perspective view of a display including a spiral display path, according to the present invention.
Figure 18:
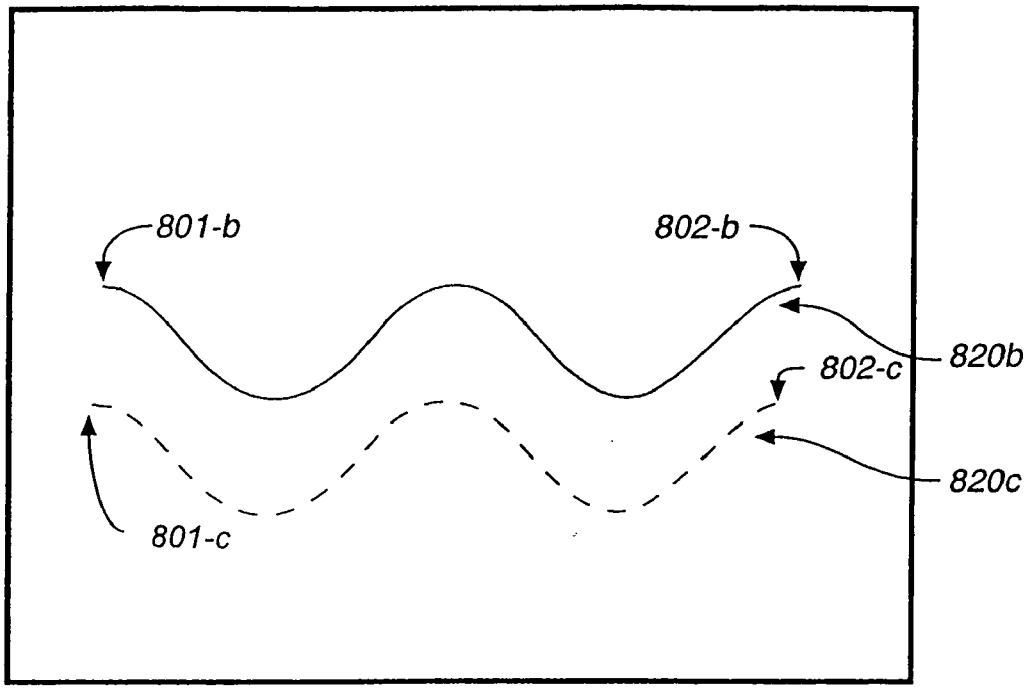
FIG. 18 is a perspective view of a display including a wave display path, according to the present invention.

FIG. 16 illustrates a graphical path 800 as a straight path including a graphical path first position 801 and a graphical path last position 802. FIG. 17 illustrates a graphical path 800*a*as a spiral path from position 801-*a* to 802-*a*. FIG 18 depicts the display path 820*b* as a wavy path which may change orientation within the display over a period of time. As shown the wavy path 820*b* from 801-*b* to 802-*b* may move to a second position 820*c* from 801-*c* to 802-*c* and may maintain a similar path pattern. Altematively, the path may evolve into a different path such as for example a straight path may change into a wavy path.

Figure 19:
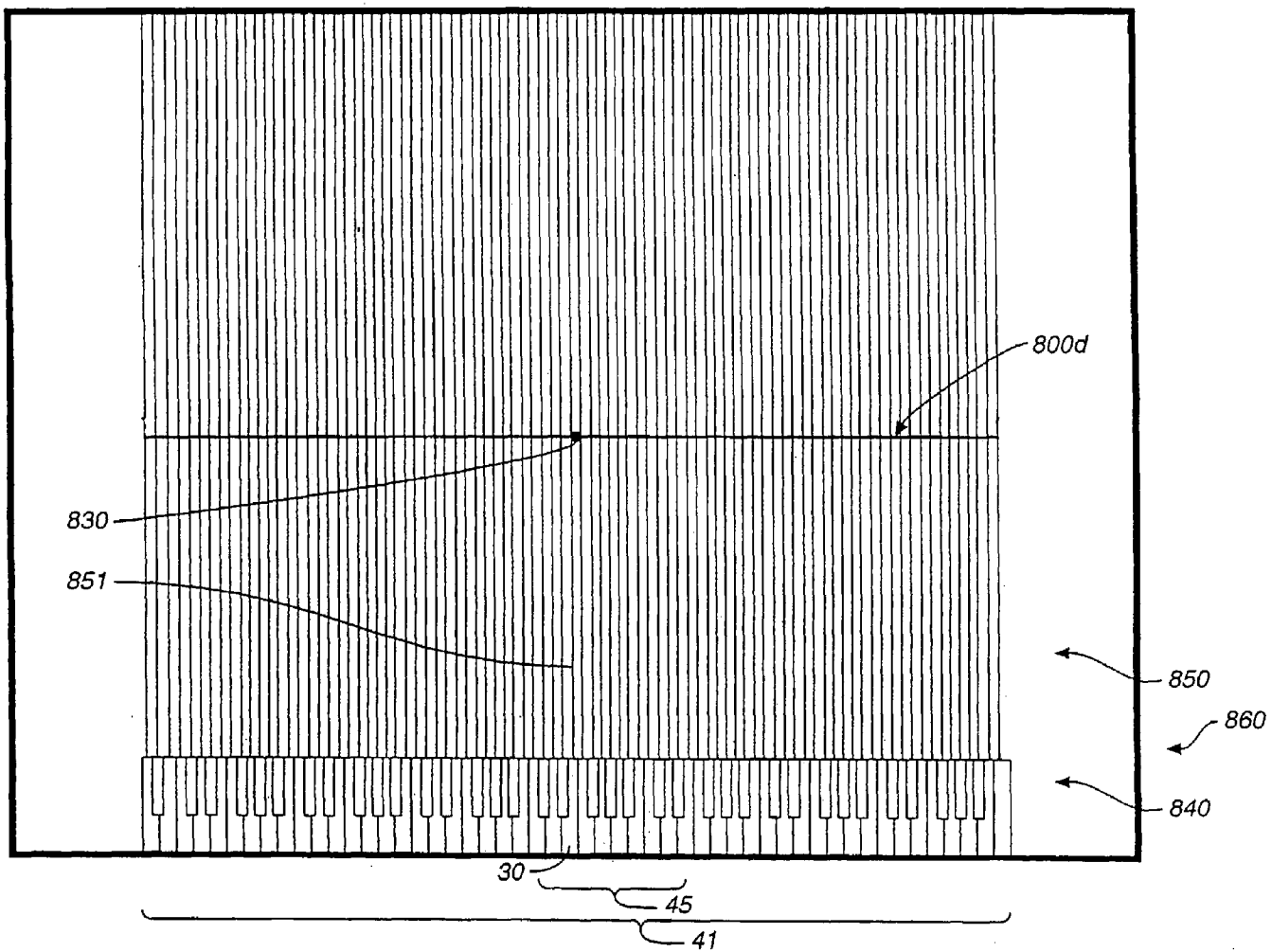
FIG. 19 is a perspective view of the display including a mock piano keyboard, according to the present invention.

FIG. 19 illustrates a graphical path 800*d* extending from 801*d* to 802*d* and a superimposed a piano keyboard image including a range of note groups 41 corresponding to range of octaves. As shown, the graphical path 800*d* has a correlation with the received notes from a piano keyboard. The reference note group 45 may be disposed as a middle octave including the note 30. Receiving the note 30 from another source 110 may result in highlighting a note line 851 from a set of note lines 850 corresponding with the superimposed keyboard image 840. Receiving the note 30 may also result in displaying a pattern at a position 830 along the graphical path 800*d*. Similarly, other received notes typically correspond with a position on the graphical path 800*d*. According to one embodiment, the graphical path 800 represents an initial display position for note representations, where the position may be modified based on the note attributes and/or color attributes.

It should also be apparent that other note attributes may be used in organizing the display position for each note. For example, inputs from the input device 50 may be taken into consideration when defining the display position. As depicted in FIG. 19 a received note may be displayed in three separate positions simultaneously. A first position along the graphical path 800 about the point 830. A second position about the note line 851. And a third position represented by the key corresponding to the note 30 on the superimposed keyboard image 840.

FIG. 19 further illustrates a display representation corresponding to the musical note source 860. As shown musical note source 860 includes a graphical path 800*d*, a set of note lines 850, and the superimposed keyboard image 840. It should also be apparent that other display information corresponding with a wide variety of musical instruments may be used to represent the display information for a musical note source.

Figure 20:
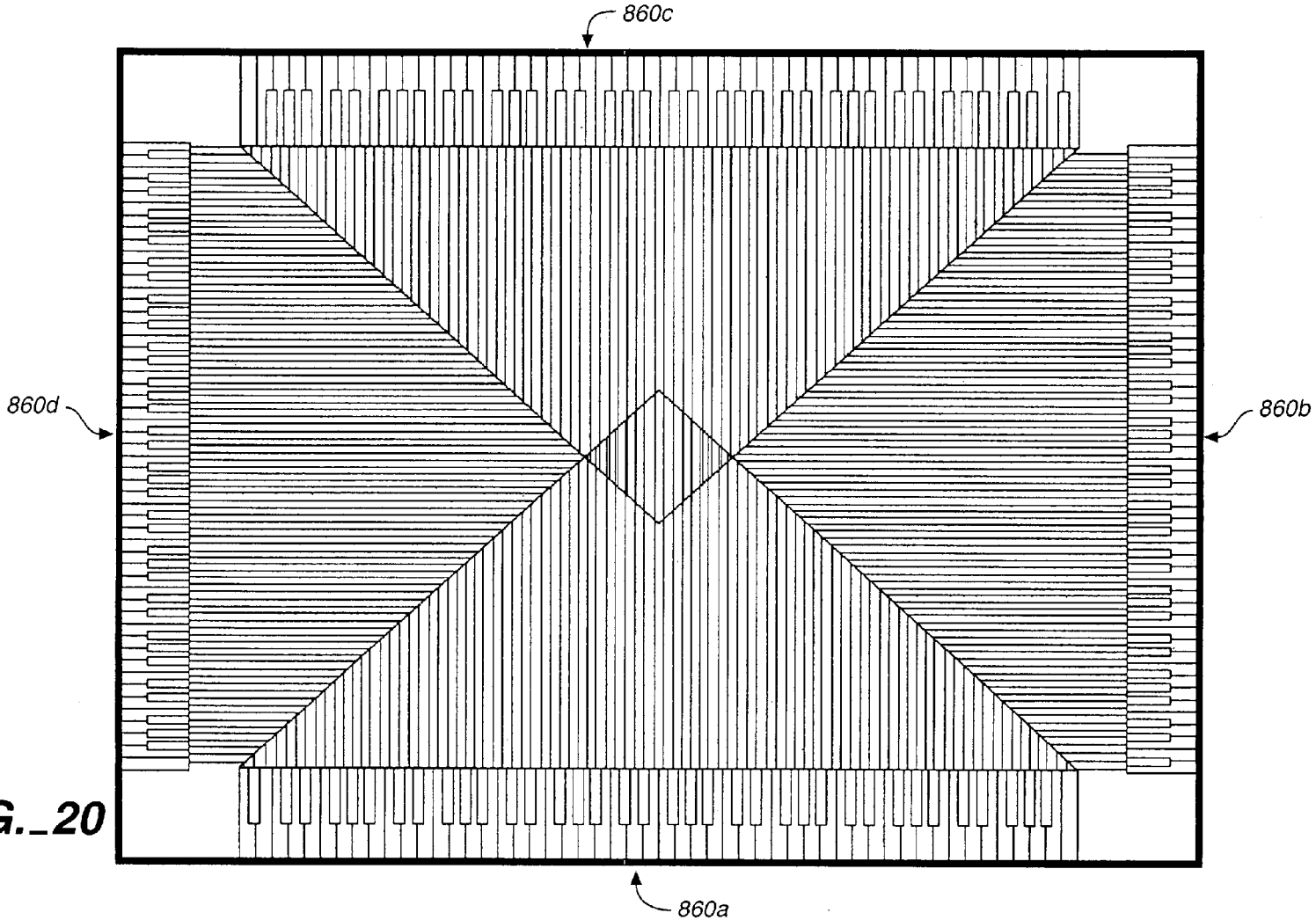
FIG. 20 is a perspective view of the display including four mock piano keyboards, according to the present invention.
Figure 21:
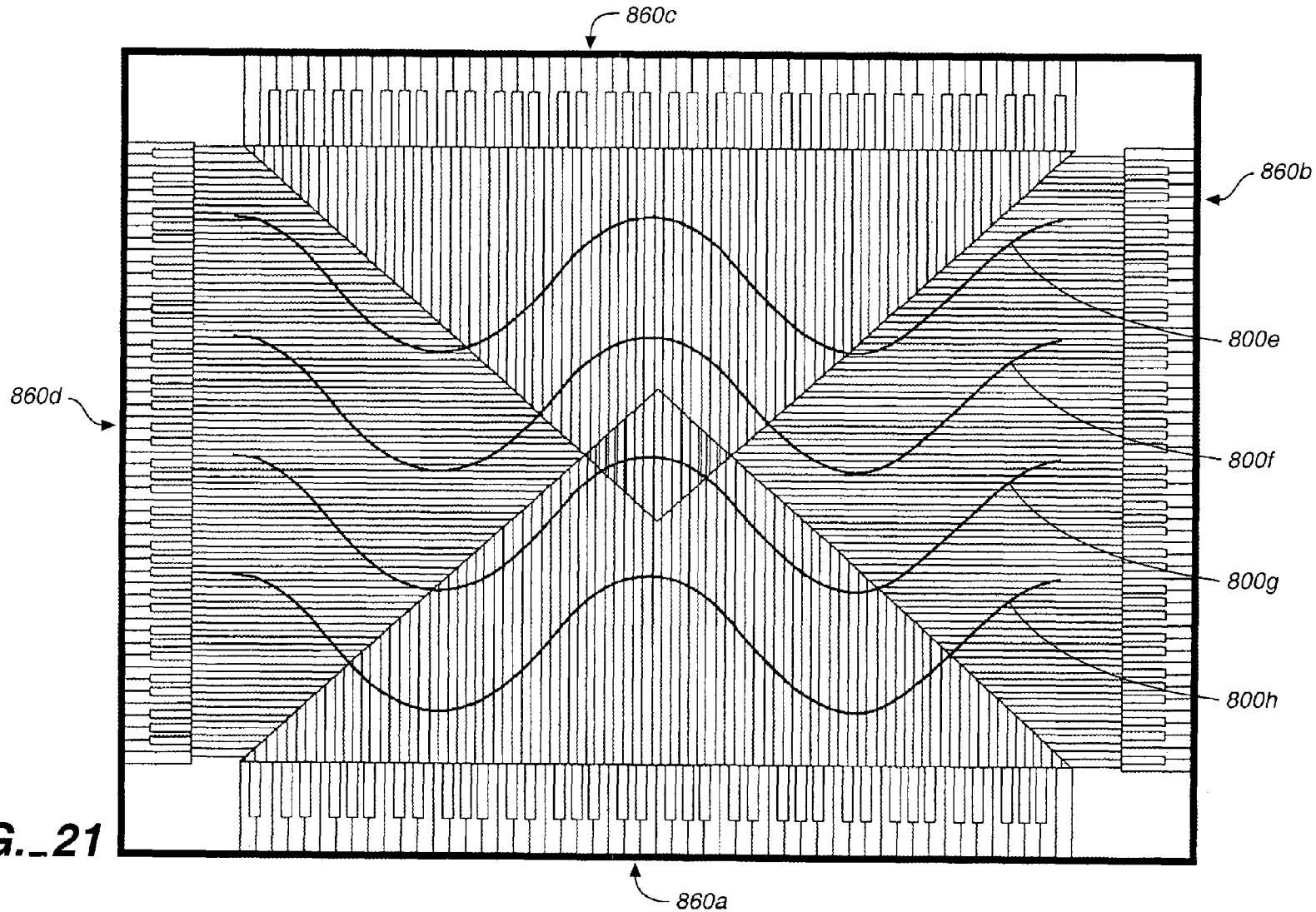
FIG. 21 is a perspective view of the display including four mock piano keyboards and corresponding display paths, according to the present invention.

FIG. 20 illustrates the musical note source 860*a*, 860*b*, 860*c*, and 860*d* corresponding to four piano keyboards. FIG. 21 further adds graphical paths 800*e*, 800*f*, 800*g*, and 800*h* corresponding to the respective musical note sources 860*a*, 860*b*, 860*c*, and 860*d*. Each musical note source 860*x* may represent separate display information corresponding to an individual musical note source such as from four separate instrument.

Figure 22:
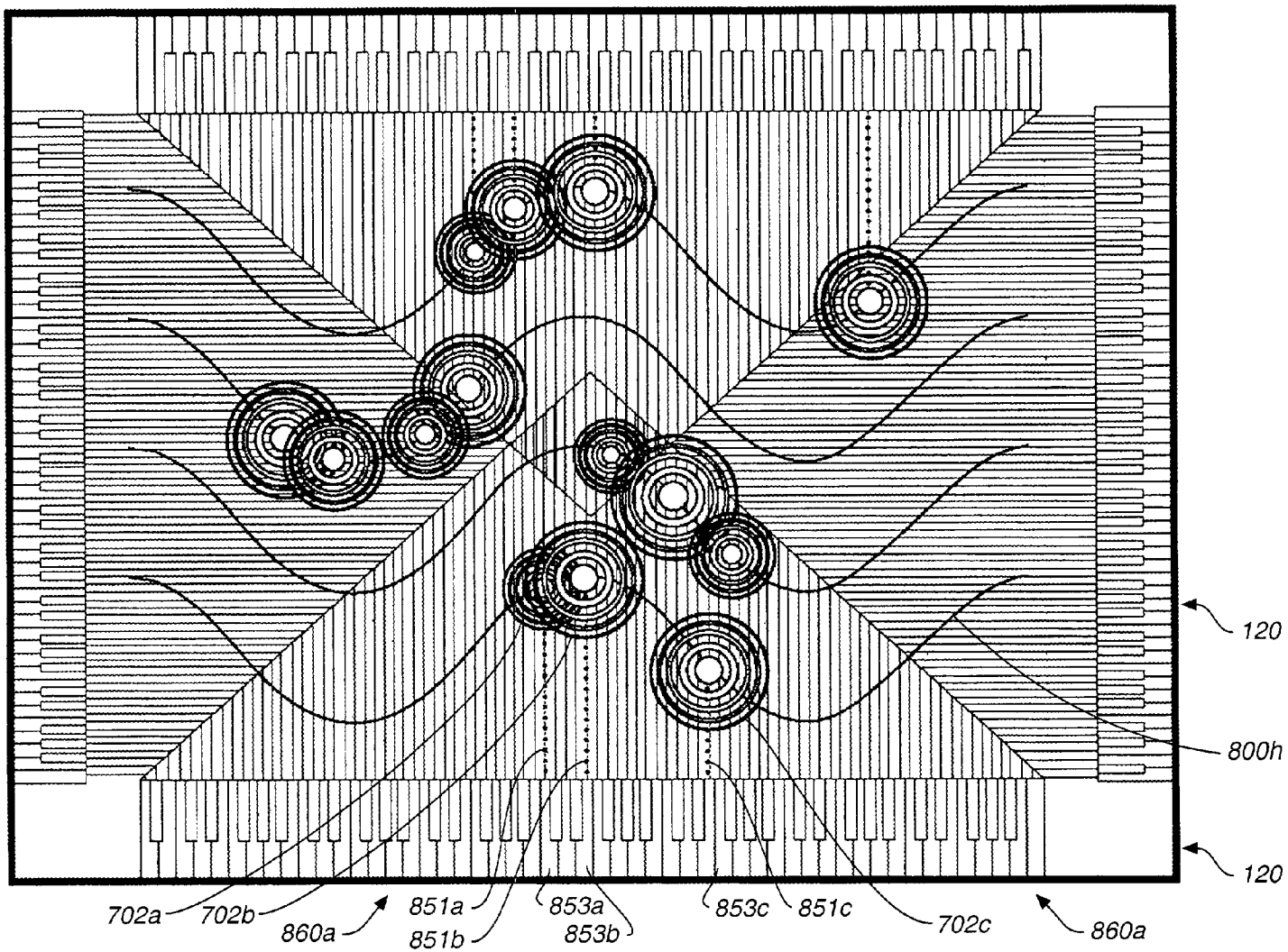
FIG. 22 represents FIG. 21 including notes being played in on the respective four keyboards.

FIG. 22 illustrates a display representation including a combination of display color, display pattern, and display position on the display device 120. The display color may be generated as described above. As illustrated, three notes have been received by the color display instrument 100, which has generated representation for the three notes. The notes are associated with the piano keyboard image keys 853*a*, 853*b*, and 853*c*. The generate representation at 400 as illustrated includes generating several corresponding representation for each received musical note. A dashed lines 851*a*, 851*b*, and 851*c* graphical representation is generated at 400 for display above the corresponding piano keyboard images. The display pattern 702*a*, 702*b*, and 702*c* graphical representation is generated at 400 for display along the display path 800*h*. A graphical representation may also have been generated at 400 for displaying color associated with the specific keys 853*a*, 853*b*, and 853*c* of the piano keyboard image. A display pattern may be generated for each received note for placement about the position on the display path 800*h*. The display pattern may also fade in and out over a duration of time.

As illustrated, the display pattern 702*a* is of smaller dimension than the display pattern 702*b*. The disparity in size may be generated in correlation with how the musical notes were received from the input source. The musical note corresponding to the display pattern 702*a* may have been released and may be fading out based on the representation generated at 400. A variety of other graphical representations of a received note and/or a group of received notes may be supported.

In a preferred embodiment, the present invention may supports receiving musical notes corresponding to a song and generating a graphical representation. The graphical representation may be displayed in conjunction with playing the song or independently of playing the song.

It should also be apparent that a variety of note attributes may be used to determine the display color, pattern, and/or position. For example, the pitch of note may be used to determine the color and position. The note intensity may be used to determine the pattern size. The note being turned "on" may result in a display pattern fading in, and correspondingly the note being turned "off" may result in the display pattern fading out.

It should also be apparent that a variety programming techniques may be used to support and implementation of described innovations using a computer 45 and/or specialized computing system. Several programming techniques may utilize the functionality of sound cards, MIDI interpreters, and/or video display languages such as for example OpenGL (TM), a trademark of Silicon Graphics of Mountain View, Calif. The OpenGL (Open Graphics Library) provides a software interface to graphics hardware. A OpenGL interface consists of a set of several hundred procedures and functions that allow a programmer to specify the objects and operations involved in producing high-quality graphical images including color images and three-dimensional objects.

Figure 23:
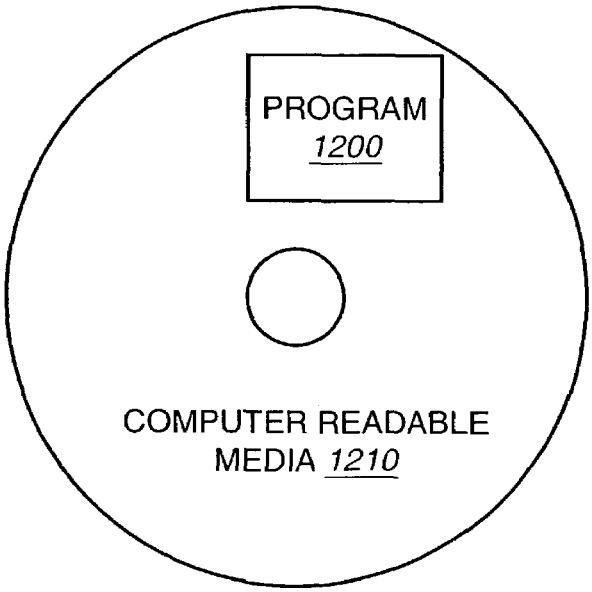
FIG. 23 depicts an embodiment of a method implemented on a computer readable media, according to the present invention.

FIG. 23 depicts an embodiment of the method according to the present invention on a computer readable media. A computer program 1200 representing at least one of the methods described herein. The program 1200 is coupled with a computer readable media 1210, such that a computer or computer system could read and execute the computer program 1200.

Figure 24:
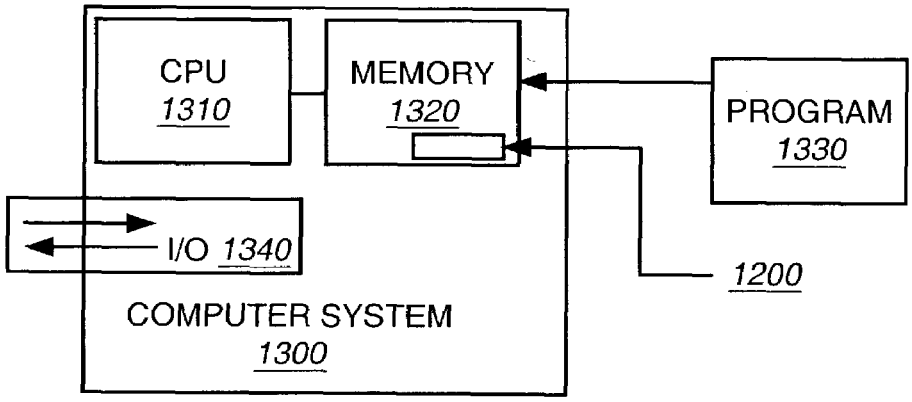
FIG. 24 depicts an embodiment of a method executed by a computer system, according to the present invention.

FIG. 24 depicts a computer system 1300 including a CPU 1310, a memory 1320, and support for input and output 1340. The computer program 1330 may be loaded into a memory 1320 accessible to the computer or the computer system 1300, which is capable of executing the program 1330. Alternatively, the program 1330 may be permanently embedded in the memory 1320. The support for input and output 1340 typically interacts with the program 1200.

Advantageously, the color display instrument can generated graphic representation of received notes. Consequently, a beautiful melody can be seen as well as heard. A further advantage of the present invention includes providing an artistic avenue for vividly presenting music to the delight of musicians and spectators alike.

For convenience in explanation and accurate definition in the appended claims, the terms "first", "last", "up" or "upper", "down" or "lower", "inside" and "outside" are used to describe features of the present invention with reference to the positions of such features as displayed in the figures.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A display instrument for operation by a user to graphically display musical notes in a selection of music extending over a range of note groups, comprising:

an input device, a computer processor coupled to the input device for receiving input from the input device and configured to respond to a) a color for each musical note in a reference note group input by the user from the input device, with related musical notes in other note groups in the range having a different shade of the color of the musical note in the reference note group, to create a color palette for the musical notes in the range of note groups, b) musical notes in the selection of music and to match the musical notes to their color and shade in the color palette so as to determine a display color for each of the musical notes, c) pattern attributes input by the user from the input device to determine a display pattern for each of the musical notes, and d) position attributes input by the user from the input device to determine a display position for the display pattern for each of the musical notes, said processor further configured to generate a display signal based on the display colors, the display patterns and the display positions, and a video display device coupled to the processor for receiving the display signal and for providing a dynamic graphical display of the musical notes on the display device.

2. A display instrument as in claim 1 wherein the processor is configured to fade the display pattern for a musical note as a function of the decreasing volume of the musical note.

3. A display instrument as in claim 1 in which the display pattern includes a shape.

4. A display instrument as in claim 1 in which the display position includes a continuous path.

5. A display instrument as in claim 4 in which the continuous path is a line selected from the group consisting of a straight line, a spiral line, a curved line and a wavy line.

6. A display instrument as in claim 1 in which the processor is configured to modify at least one of the display color, the display pattern and the display position for a musical note as a function of an attribute of the musical note selected from the group consisting of pitch, intensity, commencement and cessation.

7. A display instrument as in claim 1 in which the display pattern includes a combination of shapes.

8. A display instrument as in claim 1 in which the display pattern includes a user-creatable shape.

9. A display instrument as in claim 1 in which the display pattern includes a combination of user-creatable shapes.

10. A display instrument as in claim 1 in which each of the note groups is an octave.

11. A display instrument as in claim 1 in which the processor is configured to respond to background attributes input by the user from the input device to determine a background on which the musical notes are displayed.

12. A display instrument as in claim 1 in which the processor is configured to change the display pattern for a musical note as a function of the duration of the musical note.

13. A display instrument as in claim 1 in which the processor is configured to change the display pattern for a musical note as a function of the intensity of the musical note.

14. A display instrument as in claim 1 in which the processor is configured to change the display position for a musical note as a function of time.

15. A display instrument as in claim 1 in which the processor is configured to change the display pattern for a musical note as a function of the musical instrument playing the note in the selection of music.

16. A display instrument as in claim 1 in which the processor is configured to change the display position for a musical note as a function of the musical instrument playing the note in the selection of music.

17. A display instrument as in claim 1 for graphically displaying first and second selections of music, in which the processor is configured to generate a first display signal based on the display colors, the display pattern and the display positions relating to the first selection of music and to generate a second display signal based on the display colors, the display pattern and the display positions relating to the second selection of music, the display device receiving the first and second display signals and having a first region for providing a graphical display of the musical notes of the first selection of music and a second region for providing a graphical display of the musical notes of the second selection of music.

18. A method for graphically displaying a selection of music having musical notes extending over a range of note groups, comprising:

selecting a color for each musical note in a reference note group, with related musical notes in other note groups in the range having a different shade of the color of the musical note in the reference note group, to create a color palette for the musical notes in the range of note groups, matching the musical notes to their color and shade in the color palette so as to determine the color for the display of each of the musical notes, determining a display pattern for each of the musical notes, determining a display position for each of the musical notes, and displaying the color, display pattern and display position of each of the musical notes on a video display device to create a dynamic visual display of the selection of music.

19. The method of claim 18 in which the displaying step includes displaying the display pattern of the musical notes at different positions along a line during the display of the selection of music.

20. The method of claim 19 in which the line is a straight line.

21. The method of claim 19 in which the line is a spiral line.

22. The method of claim 19 in which the line is a wavy line.

23. The method of claim 18 in which the selecting step includes creating each of the colors in the range from a reference art work.

24. The method of claim 18 in which the range of note groups is an octave.

25. The method of claim 18 further comprising the step of providing a background on which the musical notes are displayed.

* * * * *